United States Patent [19]

Matsui

[11] 4,188,133

[45] Feb. 12, 1980

[54] DOT MATRIX IMPACT PRINTER EMPLOYING MAGNETIC DOT ELEMENTS

[75] Inventor: Hirotoshi Matsui, Shiki, Japan

[73] Assignee: Sharp Kabushiki Kaisha, Osaka, Japan

[21] Appl. No.: 881,254

[22] Filed: Feb. 27, 1978

[30] Foreign Application Priority Data

Feb. 28, 1977 [JP] Japan ..... 52-22089

[51] Int. Cl.[2] ..... B41J 3/10

[52] U.S. Cl. ..... 400/121; 101/93.04

[58] Field of Search ..... 101/93.04, 93.05; 400/121, 124, 125, 125.1

[56] References Cited

U.S. PATENT DOCUMENTS

| | | | |
|---|---|---|---|
| 3,149,901 | 9/1964 | Hagelbarger | 101/93.04X |
| 3,955,498 | 5/1976 | Scott | 101/93.31 |
| 4,089,401 | 5/1978 | Scott | 101/93.37 X |

FOREIGN PATENT DOCUMENTS

| | | | |
|---|---|---|---|
| 149148 | 3/1955 | Sweden | 101/93.04 |
| 1469634 | 4/1977 | United Kingdom | 400/125 |

*Primary Examiner*—Paul T. Sewell

*Attorney, Agent, or Firm*—Birch, Stewart, Kolasch & Birch

[57] ABSTRACT

A plurality of magnetic dot elements are provided, each of which comprises a cylindrical magnet and a conical impact member fixed to the cylindrical magnet. The magnetic dot elements are rotatable and can shift their positions along their axes. A magnetic field control is provided for controlling the orientation of each of the magnetic dot elements in accordance with print information so that the conical impact member of a selected magnetic dot element faces a print receiving member. A depression plate is provided for depressing the magnetic dot elements toward the print receiving member in such a manner that the conical impact member of the selected magnetic dot element comes into contact with the print receiving member, whereby a desired character is printed on the print receiving member in a dot matrix fashion.

12 Claims, 5 Drawing Figures

DOT MATRIX IMPACT PRINTER EMPLOYING MAGNETIC DOT ELEMENTS

BACKGROUND AND SUMMARY OF THE INVENTION

The present invention relates to a dot matrix printer of the impact type and, more particularly, to dot matrix elements employed in a dot matrix printer.

Generally, there are two types of dot matrix printers, namely, the impact type and the non-impact type. Examples of the impact type dot matrix printer are the cross point dot printer and the wire type dot printer. The non-impact type dot matrix printer is also well known in the art, for example, the electric discharge type dot printer and the ink jet system printer.

The impact type dot matrix printer is widely used, but the mechanical portion thereof is complicated and is often damaged during operation. The electric discharge type dot printer requires a chemically treated print receiving paper and generates harmful gas during operation. The ink jet system printer requires a complicated control circuit and is expensive.

Accordingly, an object of the present invention is to provide a dot matrix printer of the impact type of a simple construction.

Another object of the present invention is to provide a dot matrix printer of the impact type which ensures stable operation.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a plurality of magnetic dot elements are aligned in a matrix fashion, each of the magnetic dot elements comprising a cylindrical magnet and a conical impact member fixed to the cylindrical magnet. The magnetic dot elements are supported by a supporter in the printer in such a manner that the magnetic dot elements are rotatable and can shift their positions along their axes.

A magnetic field control means including a plurality of horizontal line conductors and a plurality of vertical line conductors is provided, each cross point of the horizontal line conductors and the vertical line conductors being positioned above the respective magnetic dot elements. The horizontal line conductors and the vertical line conductors are connected to control circuits, respectively, in order to control the orientation of each of the magnetic dot elements in accordance with print information. The magnetic field control means functions to rotate the magnetic dot elements so that the conical impact member of a selected magnetic dot element faces a print receiving member.

A depression plate is associated with the magnetic dot elements to depress the magnetic dot elements toward the print receiving member in such a manner that the conical impact members of the selected magnetic dot elements come into contact with the print receiving member with the intervention of an ink ribbon, whereby a desired character is printed on the print receiving member in a dot matrix fashion.

BRIEF DESCRIPTION OF THE DRAWINGS

The present invention will become more fully understood from the detailed description given hereinbelow and the accompanying drawings which are given by way illustration only, and thus are not limitative of the present invention and wherein.

DESCRIPTION OF THE PREFERRED EMBODIMENTS

Figure 1:
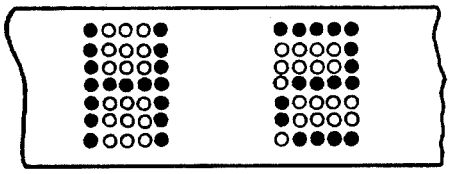
FIG. 1 is a schematic plan view showing a print format of a printer of the present invention.

FIG. 1 shows a print format of a printer of the present invention. In the drawing, the black circles correspond to selected dots. An alphabet "H" and a numeral "5" are indicated in a reversed fashion.

Figure 2:
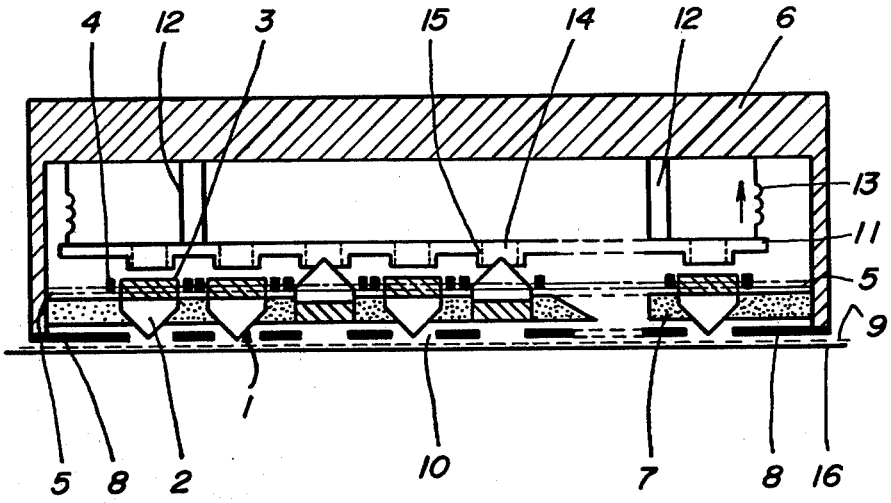
FIG. 2 is a sectional view of an essential part of an embodiment of a printer of the present invention.

FIG. 2 shows an essential part of an embodiment of a dot matrix impact printer of the present invention.

A plurality of magnetic dot elements 1 are aligned in a matrix fashion. Each of the magnetic dot elements 1 comprises a conical impact member 2 made of resin or metal, and a cylindrical magnet 3 fixed to the bottom end of the conical impact member 2.

Control principles of the dot matrix impact printer of the present invention will be described with reference to FIGS. 3 and 4.

A plurality of vertical line conductors 4 and a plurality of horizontal line conductors 5 are aligned in a lattice fashion, each cross point of the vertical line conductors 4 and the horizontal line conductors 5 being positioned above the respective magnetic dot elements 1. Each of the line conductors comprise a pair of wires, one end of each pair which are being connected to each other and the other end of each pair which are being connected to a driver circuit (not shown). The vertical line conductors 4 and the horizontal line conductors 5 form, in combination, a magnetic field control circuit. The magnetic dot elements 1 are rotatable at the cross points of the vertical line conductors 4 and the horizontal line conductors 5, and can shift their positions in a direction perpendicular to the drawing sheet of FIG. 3.

In the initial condition, every magnetic dot element 1 is placed in a state where the cylindrical magnet 3 faces the outside of the printer and the conical impact member 2 faces the inside of the printer, or the vertical and horizontal line conductors 4 and 5. One of the horizontal line conductors 5 and desired vertical line conductors 4 are selected to receive an electric current from the driver circuit flowing in the directions shown by the arrows in the drawing, thereby creating a magnetic field.

As is well known in the art, the magnet is orientated in the direction determined by a magnetic field applied thereto. The present invention utilizes the above-mentioned facts. Now assume that the strength of the magnetic field established by one of the line conductors is H, and the direction of the magnetic field established by the conductors is perpendicular to the drawing sheet of FIG. 3. As already discussed above, the magnetic dot elements 1 are positioned at the crossing points of the vertical line conductors 4 and the horizontal line conductors 5. The magnetic field established by the vertical line conductors 4 and the horizontal line conductors 5 is applied to the cylindrical magnet 3 of the magnetic dot element 1 so as to orient the magnetic dot element 1 in a desired direction.

When the strength of the magnetization of the cylindrical magnet 3, the mass of the magnetic dot element 1 and the friction against the rotation of the magnetic dot element 1 are constant, the rotation of the magnetic dot element 1 is controlled by the strength of the magnetic field applied thereto. The strength of the magnetic field is so determined that the magnetic dot element 1 can not rotate when the magnetic field of the strength H is applied to the magnetic dot element 1, but can rotate and is oriented in the direction determined by the magnetic field when the magnetic field of the strength 2H is applied to the magnetic dot element 1.

When the magnetic dot element 1, positioned at the crossing point where the selected vertical line conductor 4 and the selected horizontal line conductor 5 cross each other receives the magnetic field of the 2H strength, the cylindrical magnet 3 is attracted toward the conductors 4 and 5. Accordingly, the conical impact member 2 of the magnetic dot element 1 of the selected point faces the outside of the printer. Remaining magnetic dot elements 1 receive the magnetic field of the H strength or do not receive any magnetic field and, therefore, they do not rotate.

The selection of the vertical line conductors 4 and the horizontal line conductors 5 is achieved in a time-sharing fashion. Referring now to FIG. 4, the vertical line conductors 4 are connected to magnetic field generation circuits A through N, respectively, and the horizontal line conductors 5 are connected to magnetic field generation circuits a through m. The magnetic field generation circuit a is energized at a time $T_1$, and at the same time desired vertical line conductors 4 are selected through the use of the corresponding magnetic field generation circuits A through N. At the following time $T_2$, the magnetic field generation circuit b is energized and desired vertical line conductors 4 are selected through the use of the corresponding magnetic field generation circuits A through N.

That is, the magnetic dot elements 1 are selected row by row. More specifically, the magnetic dot elements 1 corresponding to the positions (a; A, B, C, . . . , N) are selected at a time $T_1$, the magnetic dot elements 1 corresponding to the positions (b; A, B, C, . . . , N) are selected at a time $T_2$, and the magnetic dot elements 1 corresponding to the positions (m; A, B, C, . . . , N) are selected at a time $T_n$. In order to clear or release the every magnetic dot element, all of the vertical line conductors 4 and all of the horizontal line conductors 5 are connected to receive the electric current flowing in the counter direction to the arrows shown in FIG. 3. The respective cylindrical magnets 3 receive a repulsive force from the magnetic field and thereby face the outside of the printer.

Referring again to FIG. 2, the dot matrix impact printer of the present invention further comprises a printer body 6 which secures therein the magnetic dot elements 1, the vertical line conductors 4 and the horizontal line conductors 5. A guide plate 7 is disposed in the printer body 6 for accomodating the magnetic dot elements 1. The magnetic dot elements 1 can rotate and shift their positions along their axes within openings formed in the guide plate 7. A mask plate 8 determines a front wall of the printer body 6 and confronts a print receiving paper 16 via an ink ribbon 9.

The mask plate 8 is provided with a plurality of openings 10 at positions corresponding to the magnetic dot elements 1.

The openings 10 have a diameter smaller than that of the cylindrical magnets 3 and, therefore, only the tip of the conical impact members 2 can be protruded through the openings 10.

A depression plate 11 is disposed within the printer body 6 for depressing the magnetic dot elements 1 outward of the printer body 6. The depression plate 11 is biased by springs 13, and supported by supporting legs 12 so as to perform the reciprocating movements. In the normal condition, the depression plate 11 is separated from the magnetic dot elements 1. The depression plate 11 is driven to travel downward by the supporting legs 12 when the print command is generated, thereby depressing the magnetic dot elements 1 downward.

The depression plate 11 is provided with a plurality of protrusions 15 and openings 14 formed in the protrusions 15 at positions corresponding to the magnetic dot elements 1. The openings 14 have a diameter slightly smaller than that of the cylindrical magnets 3. With such an arrangement, only selected magnetic dot elements 1, of which the cylindrical magnets 3 face up, are depressed downward by the depression plate 11 when it is driven to travel downward. Remaining magnetic dot elements 1, which are not selected, are not depressed downward by the depression plate 11 since the tips of the conical impact members 2 escape in the openings 14 formed in the depression plate 11.

Figure 5:
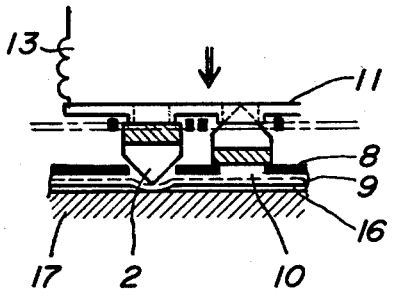
FIG. 5 is a sectional view showing an operational mode of the printer of FIG. 2.

In this way, only the conical impact members 2 of the selected magnetic dot elements 1 are placed into contact with the ink ribbon 9 to print a desired character on the print receiving paper 16 supported on a platen 17 as shown in FIG. 5.

The operation of the dot matrix impact printer of FIG. 2 is as follows:

At the beginning of the operation, the entire magnetic dot elements 1 are placed in the clear condition, wherein the cylindrical magnets 3 face the print receiving paper 16. This is conducted by supplying the electric current to the all of the vertical line conductors 4 and the horizontal line conductors 5 in the counter directions to the arrows shown in FIG. 3. After completion of the setting of the clear condition, the electric current supply is terminated.

Figure 3:
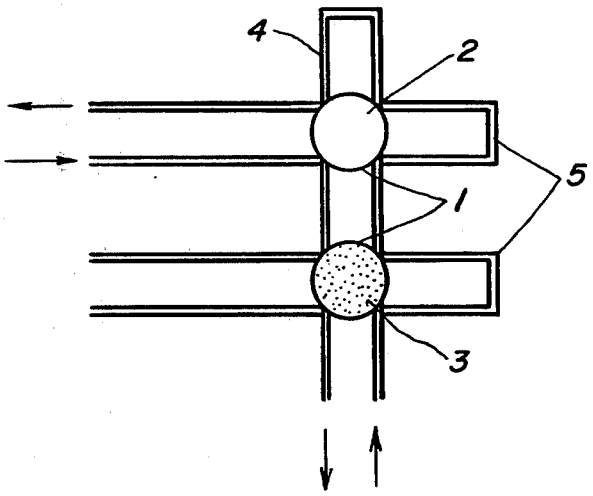
FIG. 3 is a plan view of a portion of the vertical line conductors and horizontal line conductors employed in the printer of FIG. 2.
Figure 4:
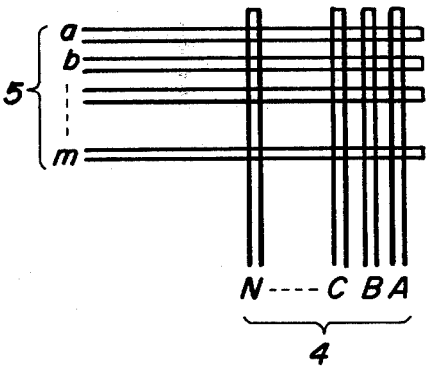
FIG. 4 is a schematic plan view showing the alignment of the vertical line conductors and the horizontal line conductors employed in the printer of FIG. 2.

The first horizontal line conductor 5 and desired vertical line conductors 4 are connected to receive the electric current flowing in the directions shown by the arrows in FIG. 3, whereby the magnetic dot elements 1 positioned at the cross points where the selected vertical line conductors 4 cross the first horizontal line conductor 5 are rotated so that the conical impact members 2 face the print receiving paper 16.

After rotation of the magnetic dot elements 1, the electric current supply is terminated, and the magnetic dot elements 1 are held stationary.

Thereafter, the second horizontal line conductor 5 and desired vertical line conductors 4 are connected to receive the electric current flowing in the directions shown by the arrows in FIG. 3. The magnetic dot elements 1 positioned at the points where the selected vertical line conductors 4 cross the second horizontal line conductor 5 are rotated so that the conical impact members 2 face the print receiving paper 16. After rotation of the magnetic dot elements 1, the electric current supply is terminated, and the magnetic dot elements 1 are held stationary.

The above-mentioned operation is repeated to the last horizontal line conductor 5, whereby the dot matrix impact printer is placed in the standby position for the printing operation. Thereafter, the depression plate 11 is driven to travel downward to shift the selected magnetic dot elements 1 downward. Accordingly, the tips of the conical impact member 2 of the selected magnetic dot elements 1 are protruded through the openings 10 formed in the mask plate 8 and is placed into contact with the ink ribbon 9 to print a desired charactor on the print receiving paper 16.

Although, in the foregoing embodiment, the horizontal line conductors 5 are selected in a time-sharing fashion and the vertical line conductors 4 are selected in accordance with the data signals, the control can be achieved in a reversed fashion. That is, the vertical line conductors 4 can be selected in a time-sharing fashion, and the horizontal line conductors 5 can be selected in accordance with the data signals.

The vertical line conductors 4 and the horizontal line conductors 5 can be formed on two flexible substrates, respectively, and the two flexible substrates can be stacked to form the matrix magnetic field control assembly. Alternatively, the vertical line conductors 4 and the horizontal line conductors 5 can be formed on both of the major surfaces of a rigid substrate.

In another form, a row of the magnetic dot elements 1 are provided for controlling the one row selection, and the print receiving paper 16 is driven to travel by one row width upon completion of the one row printing. In still another form, a column of the magnetic dot elements 1 are provided for controlling the one column printing, and the print receiving paper 16 is driven to travel by one column width upon completion of the one column printing.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A dot matrix printer for printing a desired pattern on a record receiving member in accordance with print information in a dot matrix fashion comprising:

a magnetic dot element including an impact tip end;

support means for supporting said magnetic dot element, said support means acting in conjunction with said magnetic dot element to permit said magnetic dot element to rotate along an axis transverse to the longitudinal axis of said magnetic dot element and to shift in position along an axis substantially parallel to the longitudinal axis of said magnetic dot element;

magnetic field creating means for controlling the orientation of said magnetic dot element about the transverse axis relative to said support means; and depression means for depressing said magnetic dot element toward said record receiving member.

2. The dot matrix impact printer of claim 1, wherein said magnetic dot element comprises:

a cylindrical magnet; and a conical impact member fixed to said cylindrical magnet.

3. The dot matrix impact printer of claim 2, wherein said magnetic field creating means determines the orientation of said magnetic dot element relative to said support means by rotating said magnetic dot element, the rotation of said magnetic dot element being accomplished as a result of the attractive or repulsive force of the magnetic field created by said magnetic field creating means relative to said magnetic dot element.

4. The dot matrix impact printer of claim 2, further comprising a plurality of magnetic dot elements, said magnetic field creating means determining the orientation of each of said plurality of magnetic dot elements independently of one another.

5. A dot matrix impact printer for printing a desired pattern on a record receiving member in accordance with print information in a dot matrix fashion, comprising:

a plurality of magnetic dot elements aligned in a matrix fashion, each of said magnetic dot elements including an impact tip end;

support means for supporting said magnetic dot elements, said support means acting in conjunction with each of said magnetic dot elements to permit each of said magnetic dot elements to rotate along an axis transverse to the longitudinal axis of said magnetic dot elements and to shift in position along an axis substantially parallel to the longitudinal axis of each of said magnetic dot elements;

magnetic field creating means disposed adjacent to each of said plurality of magnetic dot elements for controlling the orientation of each of said magnetic dot elements about the transverse axis relative to said support means; and depression means for depressing said magnetic dot elements toward said record receiving member.

6. The dot matrix impact printer of claim 5, wherein said magnetic field creating means comprises:

a plurality of vertical line conductors; and a plurality of horizontal line conductors oriented in a direction substantially perpendicular to the direction of orientation of said plurality of vertical line conductors thereby defining a plurality of crossing points at the intersections of said vertical and said horizontal line conductors, each of said plurality of crossing points associated with each of said plurality of vertical line conductors and said plurality of horizontal line conductors being so positioned relative to said plurality of magnetic dot elements such that certain selected ones of said plurality of magnetic dot elements rotate relative to said support means thereby pointing said impact tip end toward said record receiving member in response to energization of said vertical and said horizontal line conductors by said magnetic field creating means.

7. The dot matrix impact printer of claim 5, wherein each of said magnetic dot elements comprise a conical impact member representing the body of each of said magnetic dot elements;

a cylindrical magnet fixed to one end of said conical impact member, said impact tip end being disposed on the other end of said conical impact member and forming an integral portion thereof.

8. The dot matrix impact printer of claim 7, wherein said magnetic field creating means comprises:

a plurality of vertical line conductors;

a plurality of horizontal line conductors oriented in a direction substantially perpendicular to the direction of orientation of said vertical line conductors thereby defining a plurality of crossing points at the intersections of said vertical and said horizontal line conductors; and each of said plurality of crossing points associated with each of said plurality of vertical line and horizontal line conductors being so positioned relative to said plurality of magnetic dot elements such that the rotation of each of said magnetic dot elements is controlled by the attracting or repulsing magnetic force created by said magnetic field creating means at each of said plurality of crossing points acting in conjunction with the magnetic force created by said cylindrical magnet.

9. The dot matrix impact printer of claim 7, wherein said depression means comprises:

a depression plate provided with a plurality of openings at positions corresponding to the positions of said plurality of magnetic dot elements, said openings having a diameter smaller than the diameter of each of said cylindrical magnets of said magnetic dot elements.

10. The dot matrix impact printer of claim 9, wherein selected ones of said plurality of magnetic dot elements are not rotated along said axis transverse to the longitudinal axis of said magnetic dot elements when the magnetic field created by said magnetic field creating means at the crossing points corresponding to said selected ones of said plurality of magnetic dot elements falls below a predetermined value; and each of said impact tip ends associated with said selected ones of said plurality of magnetic dot elements protrude into the corresponding openings of said depression plate when said depression plate is driven to move into contact with said impact tip end associated with said selected magnetic dot elements.

11. The dot matrix impact printer of claim 7, further comprising an ink ribbon disposed between said record receiving member and said plurality of magnetic dot elements.

12. The dot matrix impact printer of claim 11, further comprising a mask plate disposed between said ink ribbon and said plurality of magnetic dot elements;

wherein said mask plate comprises a plurality of openings formed at positions corresponding to the positions of said plurality of magnetic dot elements;

said openings have a diameter smaller than the diameter of said cylindrical magnet associated with said magnetic dot element.

* * * * *